US010342390B2

(12) United States Patent
Austin, III et al.

(10) Patent No.: US 10,342,390 B2
(45) Date of Patent: Jul. 9, 2019

(54) BASE MEMBER FOR A SHOWER DOOR ASSEMBLY

(71) Applicant: LIBERTY HARDWARE MFG. CORP., Winston-Salem, NC (US)

(72) Inventors: James Allen Austin, III, High Point, NC (US); Nathaniel Faltin Dutton Schultz, Charlotte, NC (US)

(73) Assignee: LIBERTY HARDWARE MFG. CORP., Winston-Salem, NC (US)

( * ) Notice: Subject to any disclaimer, the term of this patent is extended or adjusted under 35 U.S.C. 154(b) by 0 days.

(21) Appl. No.: 15/984,871

(22) Filed: May 21, 2018

(65) Prior Publication Data

US 2018/0263428 A1 Sep. 20, 2018

Related U.S. Application Data

(63) Continuation of application No. 15/239,074, filed on Aug. 17, 2016, now Pat. No. 9,980,614.

(51) Int. Cl.

| | |
|---|---|
| ***A47K 3/30*** | (2006.01) |
| ***A47K 3/34*** | (2006.01) |
| ***A47K 3/36*** | (2006.01) |

(52) U.S. Cl.

CPC ..... *A47K 3/34* (2013.01); *A47K 3/36* (2013.01); *A47K 2003/305* (2013.01)

(58) Field of Classification Search

CPC ..... A47K 3/34
USPC ..... 4/605–607
See application file for complete search history.

(56) References Cited

U.S. PATENT DOCUMENTS

| | | | | | |
|---|---|---|---|---|---|
| 3,384,998 | A * | 5/1968 | Abramson | A47K 3/34 16/90 |
| 3,808,610 | A | 5/1974 | Mortensen | |
| 4,546,506 | A * | 10/1985 | Houle | A47K 3/006 4/555 |
| 4,569,092 | A * | 2/1986 | Baus | A47K 3/34 4/596 |
| 4,769,949 | A * | 9/1988 | Glendowne | A47K 3/34 16/90 |

(Continued)

FOREIGN PATENT DOCUMENTS

| | | |
|---|---|---|
| DE | 4008160 A1 | 9/1991 |
| JP | H0913715 A | 1/1997 |

*Primary Examiner* — Lori L Baker
(74) *Attorney, Agent, or Firm* — Brooks Kushman P.C.; Lora Graentzdoerffer

(57) ABSTRACT

A shower door assembly includes a door panel having an inner surface to face a bathing enclosure, and a base member having an upper surface positioned between an inner side and an outer side. The base member inner side is positioned between the door panel inner surface and the base member outer side. The inner side at least partially defines a recess and is shaped to receive liquid from and divert liquid back to the bathing enclosure. A base for a moveable door has a substrate defining upper and lower surfaces extending between first and second edge regions, and a first leg section extending from the substrate lower surface and offset from the first edge region. The first leg section and the first edge region of the substrate cooperate to define a liquid diverter extending longitudinally to redirect flow away from the substrate upper surface.

12 Claims, 8 Drawing Sheets

(56) References Cited

U.S. PATENT DOCUMENTS 4,829,608 A * 5/1989 Stevens ..... A47K 3/281 250/494.1
4,868,935 A * 9/1989 Van Weelden ..... A47K 3/34 4/610
4,878,530 A * 11/1989 Jean ..... A47K 3/34 160/211
5,023,965 A * 6/1991 Reichel ..... A47K 3/36 4/557
5,351,345 A * 10/1994 Sills ..... A47K 3/006 4/555
5,675,936 A * 10/1997 Kurth ..... A47K 3/34 49/404
5,690,157 A * 11/1997 Chen ..... A47K 3/36 16/87.4 R
5,852,837 A 12/1998 Husting
6,148,451 A * 11/2000 DeBraal ..... A47K 3/34 4/557
6,802,161 B1 * 10/2004 Robinson ..... A47K 3/008 52/287.1
6,826,867 B1 * 12/2004 McDonald ..... E05B 65/0835 49/209
7,346,939 B2 * 3/2008 Perry ..... A47K 3/34 4/557
7,607,199 B2 * 10/2009 Sprague ..... A47K 3/36 16/252
8,060,955 B2 * 11/2011 Johnson ..... A47K 3/30 4/557
8,161,582 B2 * 4/2012 Hatrick-Smith ..... A47K 3/40 4/607
8,341,774 B1 * 1/2013 Norris ..... A47K 3/34 4/557
8,707,475 B2 4/2014 Johnson et al.
9,364,121 B2 * 6/2016 Sprague ..... E05D 15/0686
9,743,809 B1 * 8/2017 Shaukat ..... A47K 3/34
2011/0197352 A1 * 8/2011 Lambert ..... A47K 3/362 4/607
2014/0068853 A1 * 3/2014 Opwald ..... A47K 3/362 4/607
2014/0259365 A1 * 9/2014 Taingtae ..... A47K 3/34 4/607
2014/0259366 A1 * 9/2014 Ball ..... A47K 3/30 4/607
2015/0113724 A1 * 4/2015 Corpuz, Jr. ..... A47K 3/36 4/607

* cited by examiner

BASE MEMBER FOR A SHOWER DOOR ASSEMBLY

CROSS-REFERENCE TO RELATED APPLICATIONS

This application is a continuation of U.S. application Ser. No. 15/239,074 filed Aug. 17, 2016, now U.S. Pat. No. 9,980,614, the disclosure of which is hereby incorporated in its entirety by reference herein.

TECHNICAL FIELD

Various embodiments relate to a base member for a door assembly, such as a sliding door or a pivoting door in a shower door assembly.

BACKGROUND

Shower or bathing enclosures often have glass doors that move or slide to enclose the bathing area and keep liquid water in the bathing area. The sliding doors move or slide on or over a frame system that has a base member, or lower frame member. Liquid water may escape the enclosure underneath the door, for example, in a region between the doors and the base member or shower sill into an otherwise dry area outside the enclosure.

SUMMARY

According to an embodiment, a shower door assembly is provided with a door panel with an upper edge portion and a lower edge portion. The door panel has an inner surface to face a bathing enclosure and an outer surface opposed thereto. The assembly has a base member with an upper surface positioned between an inner side and an outer side. The inner side of the base member at least partially defines a recess. The base member is positioned such that the inner side of the base member is between the inner surface of the door panel and the outer side of the base member. The inner side of the base member is shaped to receive liquid from the bathing enclosure via the lower edge portion of the door panel and divert liquid back to the bathing enclosure.

According to another embodiment, a base for a moveable door is provided with a substrate extending along a longitudinal axis. The substrate defines an upper surface and an opposed lower surface, with the upper and lower surfaces extending between first and second longitudinal edge regions of the substrate. The base has a first leg section extending outwardly from the lower surface of the substrate and extending longitudinally, with the first leg section being offset from the first longitudinal edge region. The first leg section and the first longitudinal edge region of the substrate cooperate to define a liquid diverter extending longitudinally to redirect flow away from the upper surface of the substrate.

According to yet another embodiment, a lower frame member for moveable doors is provided with a base extending along a longitudinal axis. The base has an upper surface positioned between a first inner side and a second outer side. At least a section of the upper surface of the base is substantially planar. The first inner side of the base defines a diverter surface having a tangent line oriented at an acute angle relative to the upper surface. The diverter surface is shaped to receive liquid from a bathing enclosure via a lower edge portion of a door panel and divert liquid back to the bathing enclosure.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
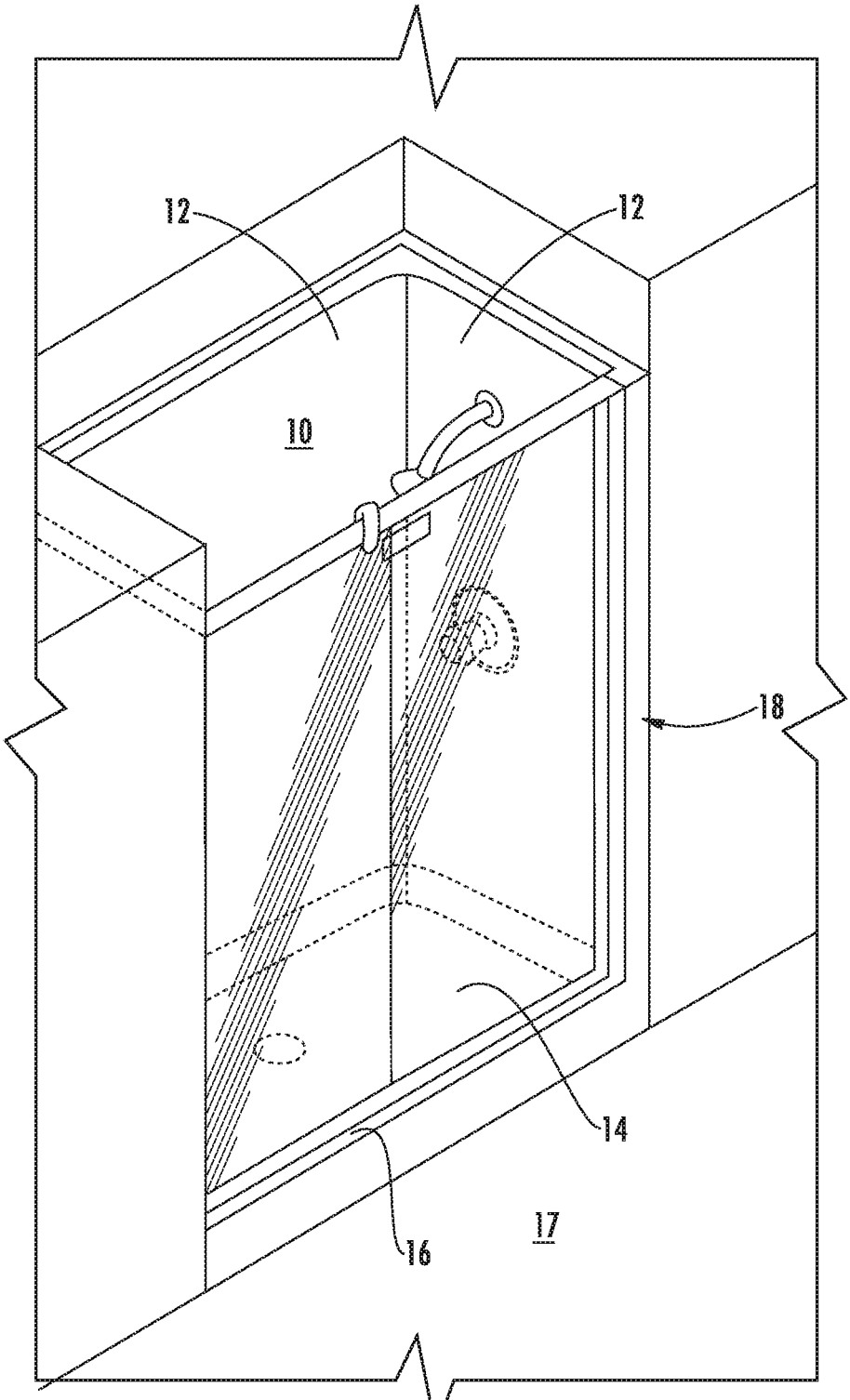
FIG. 1 is a perspective view of a door assembly according to an embodiment.
Figure 2:
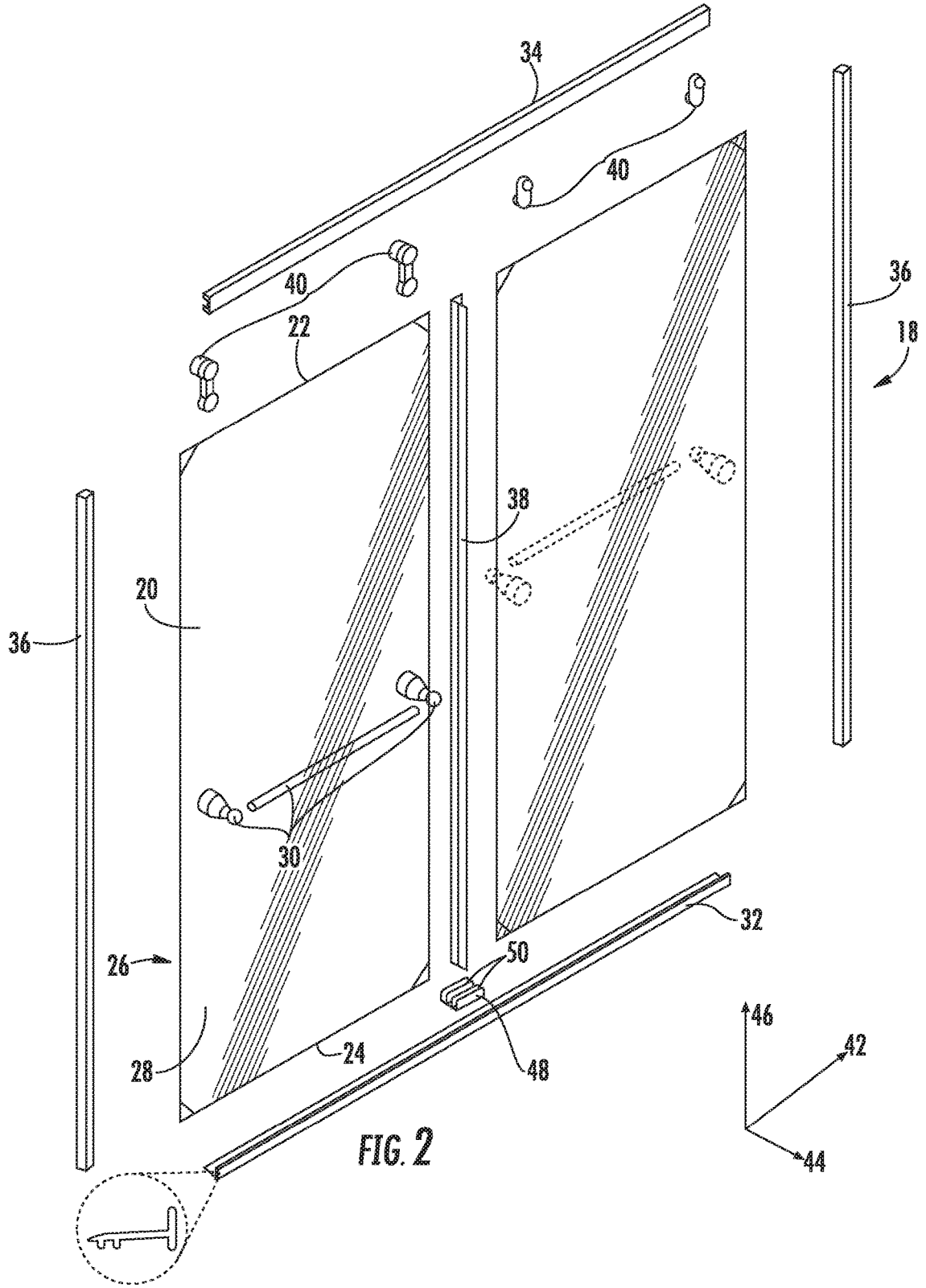
FIG. 2 is an exploded view of the door assembly of FIG. 1.

FIGS. 1-2 illustrate a bathing area or bathing enclosure 10 according to an embodiment. The bathing enclosure 10 has one or more walls 12, and a floor 14. The bathing enclosure 10 may include a shower, a bathtub, a shower and bathtub combination, or the like. A water source, such as a shower head, and valves to control the flow and temperature of water to the shower head may be provided within the enclosure 10 as shown. The walls 12 and the floor 14 cooperate to define an entrance to the bathing enclosure 10. A ceiling or other wall may additionally define the entrance to the enclosure 10. A threshold 16 is defined along the bottom of the entrance to the enclosure 10. The threshold 16 may be raised compared to the floor 14 of the enclosure 10 and a floor of the outside environment 17, for example, a bathroom floor 17 or other external environment. Alternatively, the threshold 16 may be level or flush with the floor 14 and/or the floor 17. The walls 12, floor 14, and threshold 16 may be formed as a one-piece component for installation, or may be separately formed and installed as a bathing enclosure.

The walls 12 and the threshold 16 cooperate to provide the entrance, opening or doorway to the bathing enclosure 10 for gaining access to or leaving the bathing enclosure 10. A door assembly 18 fits within and extends across at least a portion of the opening. The door assembly 18 includes one or more doors or door panels 20. In the example shown, two sliding door panels 20 are provided. In other embodiments, a greater or fewer number of door panels 20 may be used with the bathing enclosure 10. Furthermore, the one or more door panels 20 may be pivotally mounted for movement relative to the bathing enclosure 10, and/or one or more door panels may be fixed to provide another wall section of the enclosure.

The door panels 20 may be framed or frameless glass panels, may be made from a plastic panel, or from another material as is known in the art. Each door panel 20 has an upper edge portion 22 and a lower edge portion 24. Each door panel 20 also has an inner surface or inner side 26 to face the bathing enclosure 10 and an outer surface or outer side 28 opposed thereto and facing away from the bathing enclosure 10. The door panels 20 may additionally include one or more towel bars or handles 30 mounted to the door.

The door panels 20 are supported by frame members of the door assembly 18. Door assembly frame members may be separate from and installed into an existing bathing enclosure, or at least some of the frame members may be integrally formed with components of the bathing enclosure, e.g. with a one piece shower stall or the like. Frame members of the door assembly 18 include a base member 32 that extends across and is mounted to the threshold 16 of the bathing enclosure 10. The door assembly 18 may also include additional frame members such as an upper track or upper frame member 34, and side frame members 36. An optional sealing member 38 may be provided to reduce or prevent liquid flow between adjacent door panels 20. In various examples, at least one of the upper frame member 34, side frame members 36, and sealing member 38 may be omitted from the door assembly 18 based on the frame members needed to support pivoting or sliding door panels in a specific bathing enclosure 10 configuration.

The upper frame member 34 may be mounted to two opposed side walls 12 or a ceiling or top wall (not shown). The upper member 34 supports the door panel 20 for movement of the door panel 20 relative to the upper member 34 and base member 32. In the present example, the door panels 20 are sliding door panels and are hung on the upper member 34. A mechanism 40, such as a roller system or the like, may be used to connect the upper portions 22 of the door panels 20 to the upper frame member 34 and allow the sliding doors to move along a longitudinal axis 42 of the door assembly 18. The upper track 34 may have a pair of guide rails, one for each mechanism 40 on each door panel 20 such that the door panels 20 are offset from one another along a transverse or lateral axis 44. This also allows one door panel 20 to slide behind the other door panel 20, and vice versa, to open and close the opening to the enclosure 10. In the present embodiment, the second sliding door panel is positioned to be parallel with the first sliding door panel, and the first sliding door panel is positioned between the second sliding door panel and the bathing enclosure 10. In other embodiments, a single sliding door panel 20 may be provided that slides over an adjacent wall section in an open position, for example, one of the door panels 20 as shown may be fixed in place while the other is movable. The upper frame member is spaced apart from the base member along a third axis 46, such as a vertical axis, that is orthogonal to the longitudinal and transverse axes 42, 44.

The side frame members 36 may be used to provide additional structural support for the upper frame member 34 and the door panels 20. The frame members 36 may cooperate with the upper and base frames 34, 32 to act as a surround for the door panels 20 and provide a finished appearance for the assembly 18. The side frame members 36 and/or sealing member 38 may additionally provide seals to prevent liquid within the bathing enclosure from passing through the door assembly and into the outside environment.

Note that for a door assembly 18 having pivoting doors 20, the doors may be pivotally mounted on the side frame members 36, and the upper frame member may be optional.

A guide member 48 may be positioned adjacent to, be connected to, or extends from the base member 32. In other examples, the door assembly 18 may be provided without a guide member 48. The guide member 48 has a structure that is formed to interact with the door panels 20 to guide the door panels 20 along a desired path, or prevent motion of the door panels in a specified direction. In an example, the guide member 48 is used with sliding door panels and defines a channel 50 for each door panel 20. In the present example, the guide member 48 has first and second channels 50 associated with the first and second door panels 20, and the first and second channels 50 may be parallel to one another and extend longitudinally. Each channel 50 receives a corresponding lower edge portion 24 of an associated door panel 20 to allow longitudinal movement and restrict transverse or lateral movement of the lower edge portion and door panel 20. In other examples, the guide member 48 may provide a stop for a pivoting door panel, or otherwise guide and restrict motion of one or more of the door panels.

Figure 3:
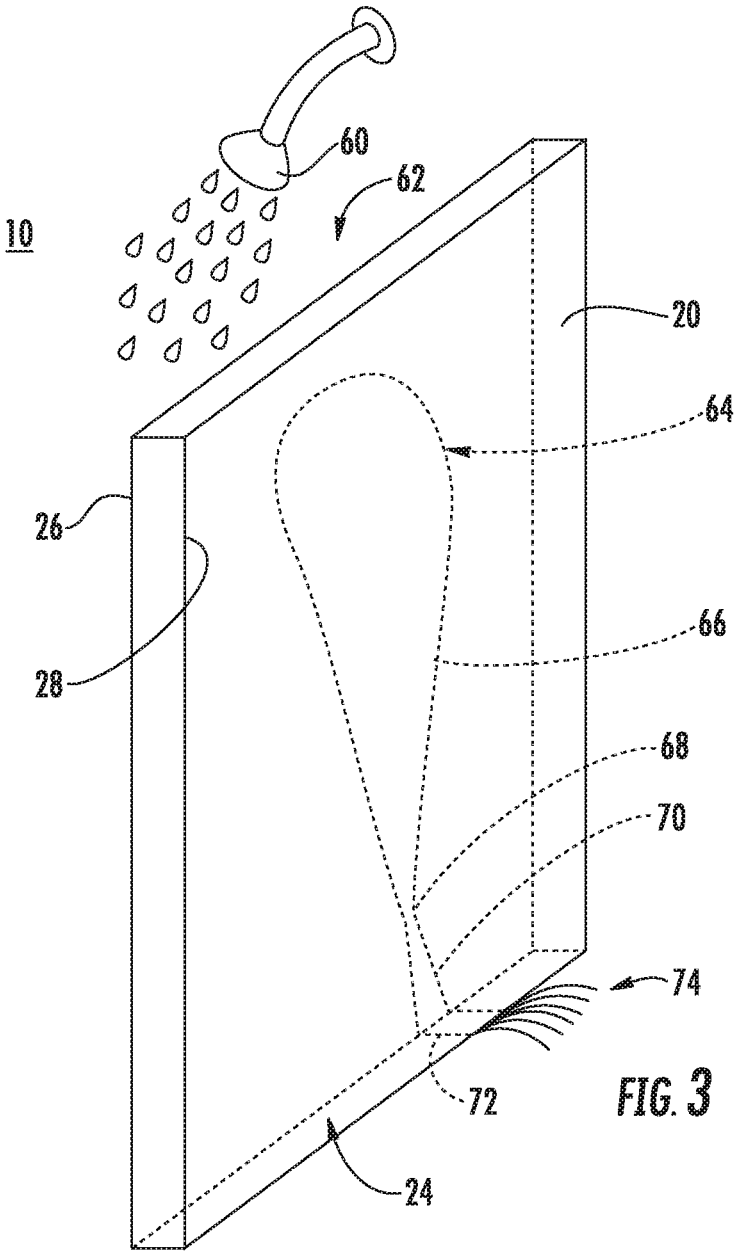
FIG. 3 is a schematic of potential liquid flow under and around a door panel.

FIG. 3 illustrates a schematic of the potential flow of a fluid, such as liquid water, from a liquid source 60 in the bathing enclosure 10 to and under/around a door panel of a door assembly installed in a bathing enclosure, such as door panel 20.

The door panel 20 may be formed from glass, plastic, or another material. At least the inner surface 26 of the door panel 20 may be treated or coated such that liquids resist adhering to the surface and run off easily to prevent water spotting, soap or other bathing product build-up, and the like. In other examples, the door panel 20 may be uncoated or untreated. When a stream of liquid 62, for example from a shower head 60, contacts the inner surface 26 of the door panel 20, the stream of liquid 62 forms a contact patch or region 64 and then tends to funnel into a narrow stream as it travels with gravity down the inner surface 26, and the treatment or coating on the door panel 20 may further enhance this liquid flow. The liquid flow may develop a funneling, narrowing, or constricted flow path 66 over the inner surface 26 of the door panel 20 based on the strong surface tension and/or internal molecular cohesion of the liquid, e.g. liquid water, the effects of which may be enhanced by being in contact with a hydrophobic surface such as the coating or treatment on the door panel.

The funneling liquid 66 may form a focal point 68 as it flows, after which a large localized flow or stream 70 of liquid water occurs on and travels down the inner surface 26 of the door panel 20. The stream 70 of liquid below the focal point 68 may maintain a generally constant width on the panel 20 or may widen slightly as it travels down the remainder of the door panel. In one example, the widest portion of the funnel 66, or impact area 64, of the liquid stream onto the inner surface 26 of the door panel, is approximately 7-8 inches, and the stream at the focal point 68 and in the stream 70 below is 1-2 inches, with a flow rate of 2.5 gallons per minute.

The stream 66, 70 of liquid may experience a rapid laminar flow as it moves down the inner surface 26 of the door panel 20, moving much faster than the individual drops for beads of liquid impacting and running down the inner surface of the door panel away from the impact region and stream. The stream 70 of liquid runs downward and then changes flow direction at the lower edge 24 of the door panel 20 as the liquid stream 70 is drawn to follow the lower edge 24 of the door panel based on adhesion of the stream with the changing shape of the surface of the panel 20. The stream 70 of liquid is therefore diverted to flow towards the outer surface 28 of the door panel, as indicated by arrow 72, and away from the bathing enclosure 10. For a door panel 20 installed in a bathing enclosure 10 without any base member 32, or for a door panel installed in a bathing enclosure with a conventional base member having a vertical or convex inner side facing the enclosure 10, the stream 70 of liquid may be further directed and form a spray 74 of liquid out of the bathing enclosure 10 as the stream of liquid has a sufficient momentum to overcome gravitational forces. This 74 spray may have a significant flow rate, and may be similar to, or on the order of, the flow rate of the stream 70.

Figure 4:
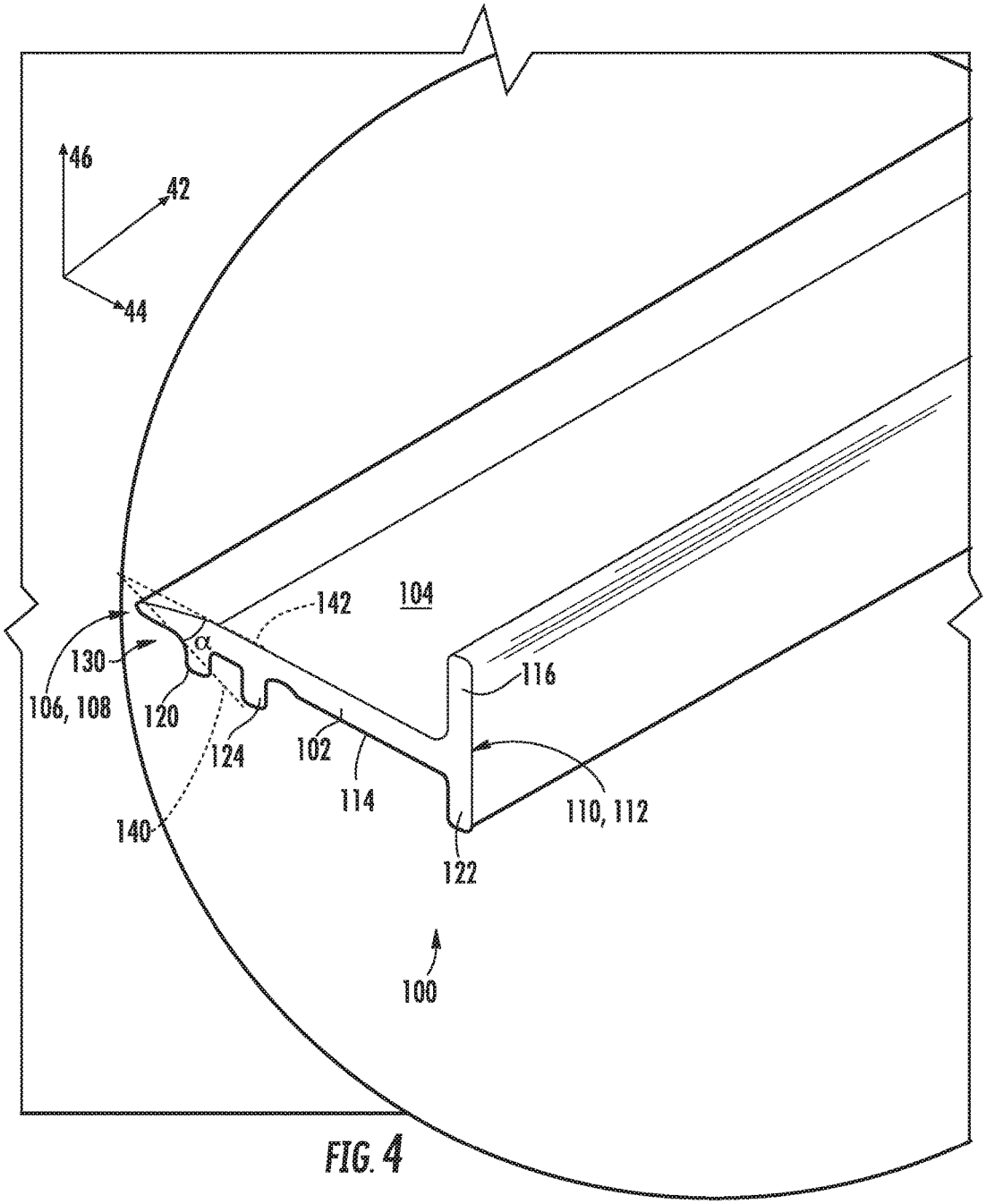
FIG. 4 is a partial perspective view of a base member according to an embodiment for use with the door assembly of FIG. 1.
Figure 5:
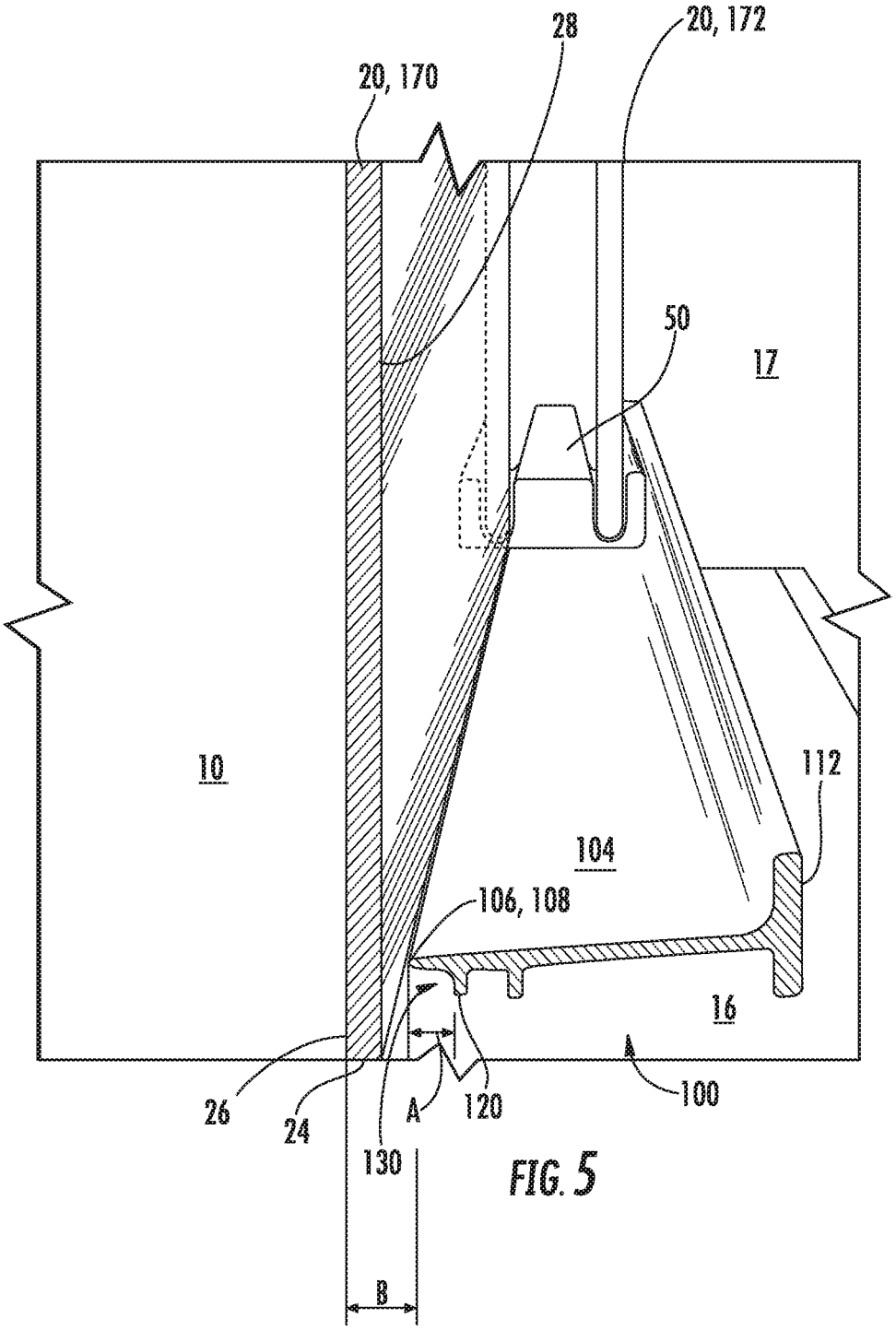
FIG. 5 is a cutaway side perspective view of the base member of FIG. 4 installed with a door assembly.

FIGS. 4-5 illustrate partial views of a base member 100 according to an embodiment and for use as a base member 32 with the door assembly 18 of FIGS. 1-2. The base member 100 is shaped to divert liquid flowing around the lower edge region 24 of a door panel 20 such that the liquid is retained within the bathing enclosure 10 and does not escape to the outside environment. The base member 100 may be integrated into the threshold 16 of a bathing enclosure 10 or may be a separate component and connected to the threshold 16 of the bathing enclosure, for example, during installation of a door assembly 18. The base member 100 is sized to extend between or behind the side frame members 36, as shown in FIGS. 1-2 with reference to element 32. The base member 100 reduces the amount of liquid that may escape the bathing enclosure 10 to an outside environment, such as a bathroom floor 17, such as that described with reference to FIG. 3 above.

The base member or lower frame member 100 may be formed from a metal, such as aluminum or an aluminum alloy, or another suitable material, including plastic. In various examples, the base member 100 is formed using an extrusion process, a molding process, or the like. The base member 100 may have a uniform cross sectional shape and size along the length of the base member 100.

The base member 100 has a substrate or a base 102 that extends along a longitudinal axis 42. The substrate 102 defines an upper surface 104. The upper surface 104 is positioned between or extends between a first longitudinal edge region 106 on a first, inner side 108 of the base 102 and a second longitudinal edge region 110 on a second, outer side 112 of the base 102. At least a transverse section of the upper surface 104 may be a planar surface, or may be a substantially planar surface, for example, having a radius of curvature several times greater than or at least an order of magnitude greater than a transverse width of the surface 104. The upper surface 104 may be sloped or angled towards the bathing enclosure 10 to provide drainage back towards the enclosure, for example, by twenty degrees or less, fifteen degrees or less, ten degrees or less of five degrees or less in various embodiments. The guide member 48 of FIGS. 1-2 may be connected to or supported by the upper surface 104.

The substrate or base 102 also defines a lower surface 114. The lower surface 114 also extends between the first longitudinal edge region 106 on the first, inner side 108 of the base 102 and the second longitudinal edge region 110 on the second, outer side 112 of the base 102.

The base member 100 may have a flange or an edge section 116 extending longitudinally adjacent to or directly adjacent to the second longitudinal edge region 110 of the substrate 102. The flange 116 extends outwardly from the upper surface 104 of the substrate 102 and towards the upper member or towards an upper edge region of a door panel when installed in a bathing enclosure. The flange or edge section 116 may form at least a portion of the outer side 112 of the base member. The upper surface 104 of the base member may be further defined as a substantially planar surface extending between the flange 116 and the inner side 108. In other examples, the base member 100 is provided without a flange 116 such that the upper surface 104 extends between the inner side 108 and the outer side 112 of the base member 100.

In the embodiment shown, the base member 100 has at least one leg section extending outwardly from the lower surface of the substrate, and extending longitudinally along the base member 100. In other examples, the function of the leg sections may be included in the structure of the substrate, for example, as an increasing or decreasing thickness of the substrate in a wedge or other similar shape. For example, the lower surface of the substrate 102 and base member 100 may extend between the outer side 112 and the diverter region as described below on the inner side 108 to support the base member 100 on an underlying surface and provide a similar function as a leg section.

In the example shown, the base member 100 has a first leg section 120 and a second leg section 122. The first leg section 120 extends outwardly from the lower surface 114 of the substrate 102, and extends longitudinally along the substrate 102. The first leg section 120 is offset transversely from the first longitudinal edge region 106 by a distance A. In one example, the first longitudinal edge region and the first leg section cooperate to form the first, inner side of the base member 100.

The second leg section 122 extends outwardly from the lower surface 114 of the substrate 102 and extends longitudinally along the substrate. The second leg section 122 is adjacent to or directly adjacent to the second longitudinal edge region 110 of the substrate 102. In one example, the flange 116 and the second leg section 122 cooperate to form the second, outer side 112 of the base member 100. In a further example, the flange 116 and the second leg section 122 are directly aligned with one another as shown in FIGS. 4-5 and form a continuous surface for the outer side 112, for example as a planar surface, curved surface, or the like. The outer side 112 may be shaped to align with surfaces on the side supports 36 when installed to form the frame.

Figure 6A:
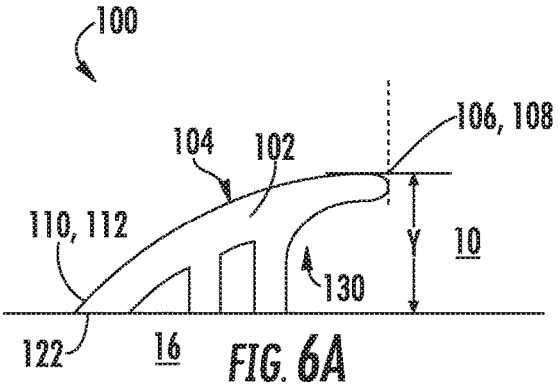
FIG. 6A and 6B illustrate section views of a variation of the base member of FIG. 4.
Figure 6B:
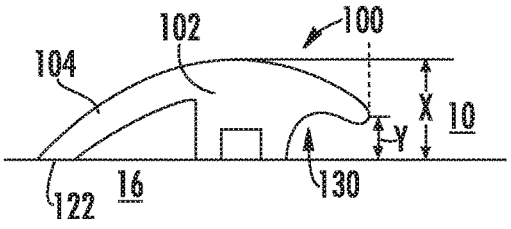

In another example, as shown in FIGS. 6A and 6B, the upper surface 104 of the base 100 has at least a section that is substantially planar and is curved overall such that the upper surface 104 extends towards and meets the threshold 16. The upper surface 104 may have a constant radius of curvature, or a varying radius of curvature such as that provided by a spline. The second leg section is thereby integrally formed with the substrate 102, and has an outer surface that is continuous with the upper surface 104. By providing a smooth or continuous curve that extends from the upper surface 104 of the base to the threshold 16, a gradual transition is provided between the outside of the bathing enclosure and the upper surface 104 to form a relatively continuous slope without a vertical or semi-vertical wall section extending upwardly from the threshold 16. This allows ease of access for users of the bathing enclosure, especially with regard to wheels of items such as wheelchairs, walkers and other such safety or assistance devices to more easily transition into the bathing enclosure. The height (y) of the inner edge and inner side 106, 108 may provide the maximum height location (x) of the upper surface 104 as shown in FIG. 6A. Alternatively, the height (y) of the inner edge and inner side 106, 108 may be less than the maximum height location (x) of the upper surface 104 as shown in FIG. 6B.

In a further example, the base member 100 has a third leg section 124. The third leg section 124 extends outwardly from the lower surface 114 of the substrate 102 and extends longitudinally along the substrate. The third leg section 124 is positioned between the first and second leg sections 120, 122. In one example, the third leg section 124 may be provided as a caulk locating feature, and/or as an additional support structure for installation of the base member 100 on underlying thresholds 16 having various widths. In further examples, the base member 100 may be provided with more than three leg sections. Additionally, various leg sections of the base member 100 may extend the length of the base member, or only partially along the length of the base member.

The first inner side 108 of the base member 100 defines a diverter surface, liquid diverter, or undercut region 130. The inner side 108 defines a recess to form the diverter 130, or at least partially defines the recessed area in cooperation with the underlying threshold 16 or underlying surface when installed to form the diverter 130. The inner side 108 is shaped to receive liquid from the bathing enclosure 10 via the lower edge portion 24 of the door panel 20 and divert liquid back to the bathing enclosure 10 to reduce or prevent the flow of liquid to the outside environment 17. The diverter 130 extends longitudinally along the inner side 108 of the base member 100. The diverter 130 surface is shaped to receive the stream 70 of liquid from the bathing enclosure 10 that is flowing around the lower edge portion of the door panel as shown by arrow 72 in FIG. 3, and divert and redirect the liquid back to the bathing enclosure 10. This reduces or prevents the flow of liquid over the upper surface 104 of the base member 100, by reducing or preventing the jet 74 of liquid out of the bathing enclosure 10 or otherwise preventing liquid from exiting the bathing enclosure 10.

In one example, the first longitudinal edge region 106 and the first leg section 120 cooperate to define the liquid diverter 130 that extends longitudinally and redirects flow away from the upper surface 104 of the substrate. The undersurface of the first longitudinal edge region 106 and a surface of the first leg section 120 may be shaped to define the diverter 130. The first leg section 120 may additionally be offset, by distance A, from the first edge region 106 to provide a predetermined transverse depth for the diverter 130.

In a further example, the surface of the diverter 130 has a tangent line 140 that is oriented at an acute angle $\alpha$ relative to the tangent line 142 of the upper surface 104 or plane substantially defining the upper surface 104, where the acute angle extends through the structure of the substrate 102 as shown.

The diverter 130 surface may be formed as a concave shape or surface that extends longitudinally on inner side 108 of the base member. The concave shape or surface may be defined by at least one of the first leg section 120 and the first longitudinal edge region 106. The concave surface may have a constant radius of curvature along the length of the base member 100. In other examples, the concave surface may be provided by a varying radius of curvature or another spline function. The diverter 130 shape in FIGS. 4-5 is a smooth concave curve that tangentially joins with the undersurface of the first edge region 106 and the outer surface of the first leg section 120.

The diverter 130 may be provided on the inner side of the base member 100 with various concave or undercut shapes, for example, varying diagonal cuts, radii and concave-positive curves, and the like. FIGS. 7A-7J illustrate partial side views of diverters according to various examples that may be implemented with the base member 100 in place of the diverter 130 shape as shown in FIGS. 4-5.

Figure 7A:
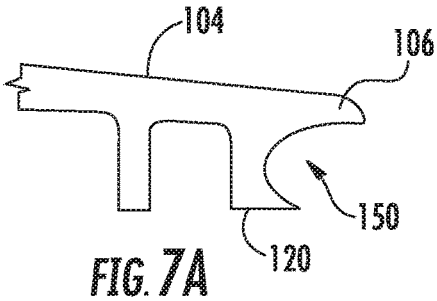
FIGS. 7A-7J illustrate partial sectional views of diverter regions of a base member according to various embodiments.
Figure 7B:
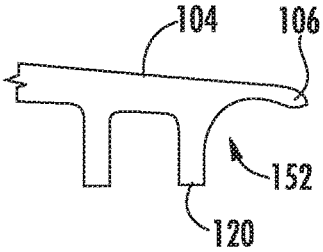
Figure 7C:
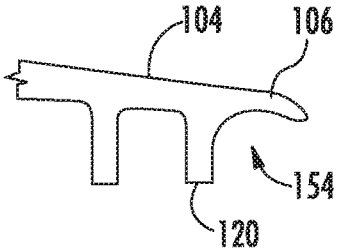

FIGS. 7A-7D illustrate variations on concave curves for use as the diverter shape. A concave curve in the diverter 130 may be provided as a constant or varying radius of curvature or, alternatively, may be provided as a constant or varying spline function. FIG. 7A illustrates an exaggerated concave curve 150 on the first leg section 120. In FIG. 7B, the diverter is shaped as concave curve 152 that extends into the structure of the substrate itself, thereby providing a higher curved undercut region. In FIG. 7C, the diverter is shaped as a concave curve 154 with the first longitudinal edge 106 tipped downwardly towards the leg section 120.

Figure 7D:
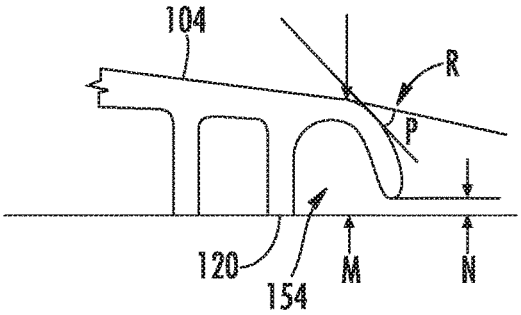

FIG. 7D illustrates the diverter with a concave curve 154 with the first longitudinal edge 106 tipped further downwardly towards the leg section 120. As can be seen in FIG. 7D, the root section of the first longitudinal edge 106 is spaced a distance M from the underlying surface, and the end of the first longitudinal edge 106 is spaced a distance N from the underlying surface, with N being greater than zero, and M being greater than or equal to N. Also shown in FIG. 7D, the edge 106 has a radius of curvature R, with an angle P that may be in the range of 10-80 degrees, 30-60 degrees, and in alternative examples P may be zero degrees.

Figure 7E:
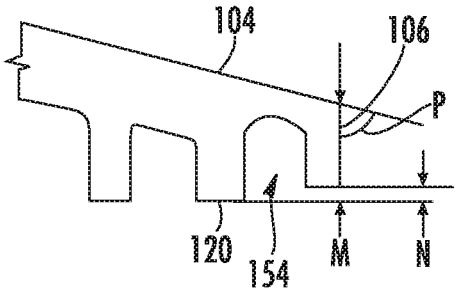

FIG. 7E illustrates the diverter 130 with a combination of a concave curve planar surface, and with the first longitudinal edge 106 tipped downwardly towards the leg section 120. As can be seen in FIG. 7E, the root section of the first longitudinal edge 106 is spaced a distance M from the underlying surface, and the end of the first longitudinal edge 106 is spaced a distance N from the underlying surface, with N being greater than zero, and M being greater than or equal to N. Also shown in FIG. 7E, the edge 106 has an angle P that may be in the range of 0-90 degrees, 10-80 degrees, 30-60 degrees, and in alternative examples P may be 80-90 degrees.

Figure 7F:
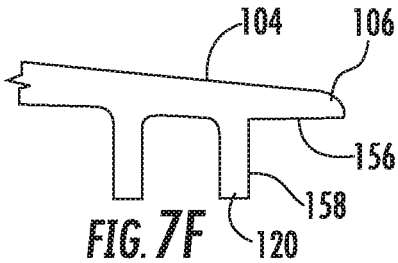

In FIG. 7F, the diverter is formed by the intersection of two planar or substantially planar surfaces 156, 158. The planar surfaces 156, 158 may be oriented perpendicularly to one another, or may be oriented at an acute or obtuse angle relative to one another.

Figure 7G:
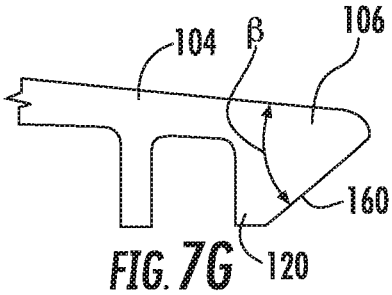
Figure 7H:
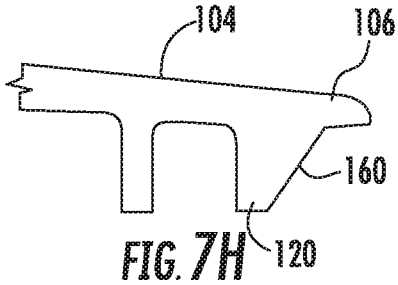
Figure 7I:
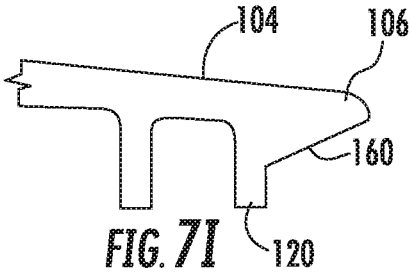
Figure 7J:
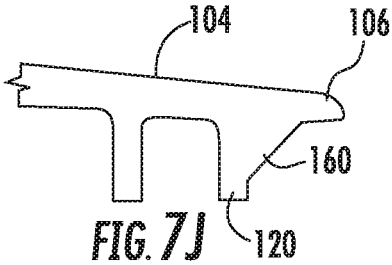

The inner side 108 of the base member 100 in FIGS. 7G-7J may include a beveled surface oriented at an acute angle relative to the upper surface 104 of the base member and extending longitudinally along the inner side of the base member. In FIGS. 7G-7J, the diverter 130 may be at least partially formed by an interior chamfer or a fillet 160 positioned between or formed by the first leg section 120 and the first longitudinal edge region 106 of the substrate 102. The beveled surface, interior chamfer or fillet may extend to the inner edge itself of the base member as shown in FIGS. 7G and 7I, may extend to the lower edge of the first leg section as shown in FIGS. 7G and 7H, or may be offset from one or both of the edges as shown in FIG. 7J. For example, the beveled surface, interior chamfer or fillet 160 is offset from both edges in FIG. 7J. The chamfer 160 may be provided at different acute angles $\beta$ relative to the upper surface 104 of the substrate, and the acute angle may be set within a range of 10-80 degrees, 30-60 degrees, 40-50 degrees, or at approximately 45 degrees. For simplicity, the angle $\beta$ is only shown in FIG. 7G, but is similarly provided in FIGS. 7H-7J.

Figure 8:
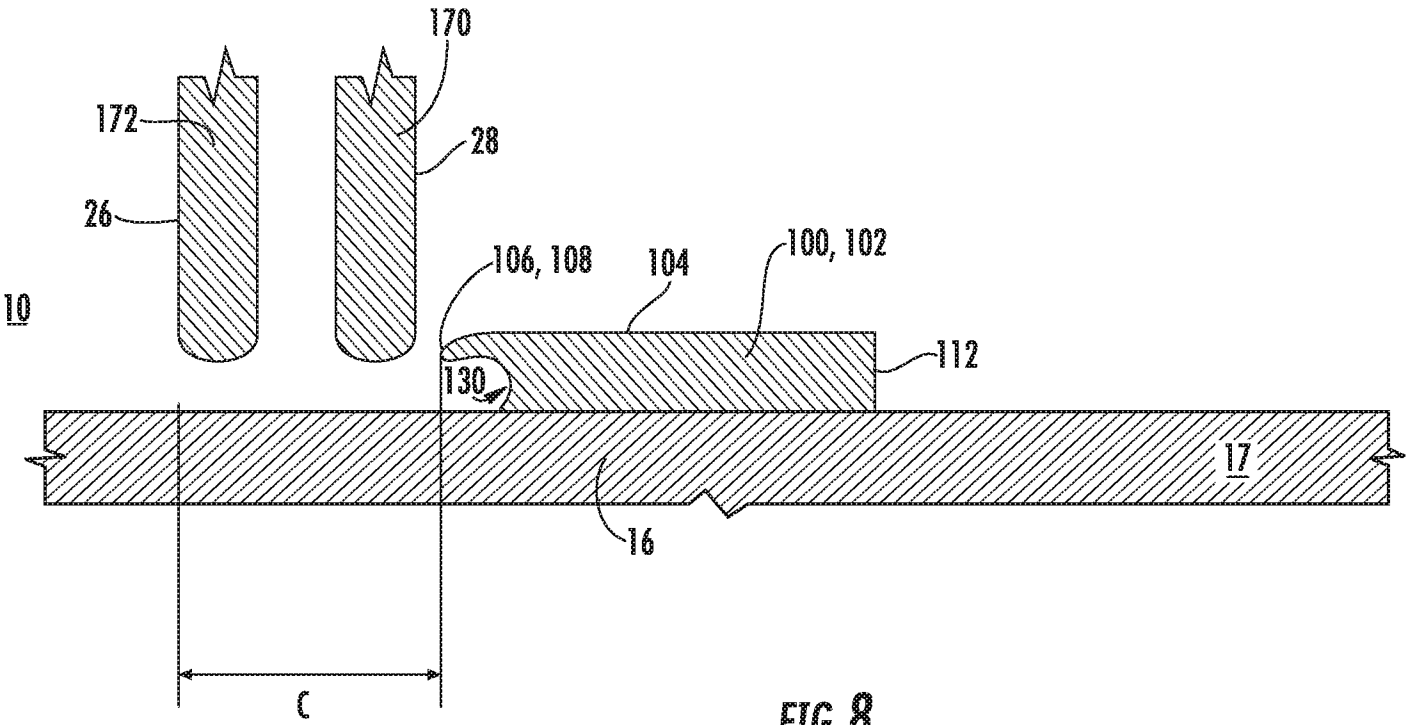
FIG. 8 is a cutaway side perspective view of the base member of FIG. 4 installed with another door assembly.

Referring back to FIG. 5, the base member 100 is positioned relative to the door panels 20 of the door assembly. The base member 100 is positioned such that the inner side 108 of the base member 100 is positioned between the inner surface 26 of the door panel 20, 170 and the outer side 112. The outer side 112 of the base member is adjacent to the outside environment 17. The base member 100 may be positioned at a specified distance B outboard from the inner surface 26 of the door panel 20, 170. The base member 100 may be positioned such that the door panel 20, 170 is positioned between the outer side 112 of the base member and the bathing enclosure 10. The second sliding door panel 20, 172 may be positioned between the first sliding door panel 170 and the outer side 112 of the base member such that inner side 108 of the base member is also positioned between the inner surface 26 of the first sliding door panel 170 and the inner side 26 of the second sliding door panel 172. Alternatively, as shown in FIG. 8, the second door panel 172 is positioned between the first sliding door panel 170 and the bathing enclosure 10 such that the inner side 108 of the base member is positioned between the inner surface of the second door panel 172 and the outer side 112 and at a specified distance outboard C from the inner surface 26 of the second door panel 172 which may position the inner side 108 of the base member between the outer side 28 of the first door panel 170 and the outer side 112. Note that in FIG. 8, the base member 100 is illustrated according to another example with the substrate 102 itself providing the leg sections or supporting structure for the base on the underlying threshold 16.

Referring back to FIG. 5, the specified distance B from the inner surface 26 of the door panel 20, 170 and the specified undercut geometry of the diverter 130 act to divert any liquid stream flowing around the lower edge region 24 of the door panel 20 by redirecting the jet of liquid and/or reducing the height of the jet. In one example, the specified distance B is set such that the inner side 108 of the base member is between the inner and outer surfaces 26, 28 of the door panel. In another example, the specified distance B is set such that the inner side 108 of the base member is slightly outboard of the outer surface 28 of the door panel, for example, on the order of millimeters.

As the size of the undercut region 130 increases, the capacity of the diverter 130 to redirect liquid to the bathing area 10 may correspondingly increase. A limit to the size of the diverter 130 may be reached based on manufacturability limitations. The diverter 130 may additionally reduce noise associated with the flowing liquid, for example, by reducing the sound created by bubbling or splashing liquid water to a softer hissing noise.

A shower door assembly 18 may be installed into a bathing area or enclosure 10 as follows. A first door panel 20 is installed in an opening to a bathing area 10 with a first side 26 of the first door panel facing the bathing area, for example, by installing the first door panel onto an upper track 34 or other frame member. A second door panel 20 may additionally by installed in the opening of the bathing enclosure 10 with a first side 26 of the second door panel facing the bathing area, and the first door panel positioned between the second door panel and the bathing area, for example, by installing the second door panel 20 onto the upper track 34 or other frame member.

A base 32, 100 is installed in the opening to the bathing area 10, for example, on a threshold 16 of the opening. The base is installed such that the first longitudinal edge region 106 of the substrate 102 is positioned between the bathing area 10 and the first leg section 120. The base 100 is installed and positioned such that the first door panel 170 is positioned between the second longitudinal edge region 110 of the substrate and the bathing area 10. The base 100 is installed and positioned such that the first longitudinal edge region 106 of the substrate is positioned between the first side 26 of the first door panel 170 and the first side 26 of the second door panel 172. Alternatively, the base 100 is installed and positioned such that the first longitudinal edge region 106 of the substrate is positioned between the first side 26 of one of the door panels 20 and the outside environment 17.

A guide member 48 may be installed onto or near the upper surface 104 of the substrate to restrict and guide the motion of the door panels 20. In one example, a bottom edge 24 of the first door panel is received within a first channel 50 defined by the guide member to allow longitudinal movement and restrict transverse movement of the first door panel 20, 170.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method of installing a shower door assembly, the method comprising:

installing a first door panel into an opening of a bathing area with a first side of the first door panel facing the bathing area; and installing a lower frame member in the opening to a bathing area, the lower frame member extending along a longitudinal axis and having an upper surface positioned between an inner side and an outer side, at least a section of the upper surface being substantially planar, the inner side defining an innermost edge of the lower frame member, the inner side defining a diverter surface having a tangent line oriented at an acute angle relative to the upper surface thereby forming a recessed area beneath the innermost edge, wherein the lower frame member is installed on a threshold of the opening such that the inner side is positioned between the bathing area and the outer side, the lower frame member positioned such that the first door panel is positioned between the outer side and the bathing area.

2. The method of claim 1 further comprising installing a second door panel into the opening of the bathing area with a first side of the second door panel facing the bathing area, the first door panel positioned between the second door panel and the bathing area;

wherein the lower frame member is installed such that the innermost edge of the lower frame member is positioned between the first side of the first door panel and the first side of the second door panel.

3. The method of claim 1 further comprising installing a second door panel into the opening of the bathing area with a first side of the second door panel facing the bathing area, the first door panel positioned between the second door panel and the bathing area;

wherein the lower frame member is installed such that the first side of the first door panel and the first side of the second door panel are each positioned between the innermost edge of the lower frame member and the bathing area.

4. The method of claim 1 wherein the diverter surface extends continuously and longitudinally along the lower frame member.

5. The method of claim 1 wherein the lower frame member is installed such that the diverter surface is unblocked and open to the bathing area.

6. The method of claim 1 further comprising providing a lower frame member with the diverter surface shaped to receive liquid from the bathing area via a lower edge portion of a door panel and divert liquid back to the bathing area.

7. The method of claim 1 further comprising installing an upper frame member to support the first door panel for movement of the first door panel relative to the opening.

8. The method of claim 1 wherein the lower frame member is installed such that the first side of the first door panel is positioned between the innermost edge of the lower frame member and the bathing area.

9. The method of claim 8 wherein the innermost edge of the lower frame member is positioned at a specified distance outboard of the first side of the first door panel.

10. The method of claim 1 wherein the first door panel has a second side opposite to the first side; and wherein the lower frame member is installed such that the innermost edge of the lower frame member is positioned between the first side and the second side of the first door panel.

11. The method of claim 1 wherein the first door panel has a second side opposite to the first side; and wherein the lower frame member is installed such that the first and second sides of the first door panel are each positioned between the innermost edge of the lower frame member and the bathing area such that the innermost edge of the lower frame member is outboard of the second side of the first door panel.

12. The method of claim 3 wherein the innermost edge of the lower frame member is positioned at a first specified distance outboard of the first side of the first door panel, and at a second specified distance outboard of the first side of the second door panel.

* * * * *